428-408

11/10/81 XR 4,299,878 SR

United States Patent [19]

Rheaume

[11] 4,299,878

[45] Nov. 10, 1981

[54] BIAS CUT, CONTINUOUS FABRIC OF CERAMIC OR SYNTHETIC FIBERS

[75] Inventor: Walter A. Rheaume, Fullerton, Calif.

[73] Assignee: Textile Products Incorporated, Anaheim, Calif.

[21] Appl. No.: 108,582

[22] Filed: Dec. 31, 1979

[51] Int. Cl.[3] ..... B32B 7/00

[52] U.S. Cl. ..... 428/257; 139/291 C; 139/387 R; 156/148; 156/149; 156/256; 156/555; 428/36; 428/245; 428/408; 428/426; 428/902; 428/910

[58] Field of Search ..... 156/148, 149, 256, 555, 156/174, 426, 393; 139/387 R, DIG. 1, 11, 13 R, 291 C; 428/36, 245, 257, 260, 343, 408, 426, 902, 910

[56] References Cited

U.S. PATENT DOCUMENTS 2,672,163 3/1954 Walters ..... 139/116

3,426,804 2/1969 Bluck ..... 139/11

3,437,537 4/1969 Takada ..... 156/149

3,832,210 8/1974 Rohlfing ..... 428/257

*Primary Examiner*—James J. Bell

*Attorney, Agent, or Firm*—Willie Krawitz

[57] ABSTRACT

An apparatus and process for producing a unique, continuous and endless, bias cut fabric employing ceramic and synthetic fibers is disclosed. The apparatus comprises a take up roll system positioned at the output of a tubular weaving operation.

The roll system takes up the tube evenly and ensures a uniform movement of the tube through the system to maintain a uniform weave oriented at 90° to the fabric length.

This permits the tube, as it leaves the system, to be cut diagonally and to be unwound as a lay flat fabric having a uniform weave pattern oriented at a bias to the fabric length.

12 Claims, 5 Drawing Figures

BIAS CUT, CONTINUOUS FABRIC OF CERAMIC OR SYNTHETIC FIBERS

BACKGROUND OF THE INVENTION

This invention relates to a new and improved apparatus and process for producing a new and improved continuous and endless ceramic or synthetic fabric from glass, graphite, boron, quartz, aramid (e.g. Kevlar), nylon, saran, polyester, polyolefine, etc.; the fabric of this invention has a weave oriented at a bias to the fabric length.

These ceramic and synthetic fabrics are used as a reinforcement for structural elements which are subject to a variety of stresses, particularly torsion stresses; frequently, the stresses are produced along the length of the applied fabric. Since the usual orientation of a fabric weave is perpendicular (i.e. 90°) to the fabric length, it is customary to convert the 90° fabric weave to a bias orientation. This conversion involves cutting or slitting a fabric such as graphite diagonally along the length into sections which are then reassembled and sewn together into a continuous fabric which is biased along its length.

This method of reassembling the graphite fabric sections is time consuming and also, some material is lost due to the geometry of reassembly. In addition, when the sections are sewn back together, this requires extra labor, and more time is lost; also, the join lines due to the sewing become lines of weaknesses in the reassembled fabric.

There is required an apparatus and process for converting a ceramic or synthetic fabric from a 90° weave to a bias orientation without the time consuming and expensive steps involved in the prior method. Also, it would be desirable to produce a one-piece, endless, bias cut, graphite fabric without the presence of join lines.

Take up roll systems that produce tubular fabrics for use as belts are known (e.g. U.S. Pat. No. 2,672,163) but do not provide a sufficiently uniform weave which is imperative if the ceramic fabric is employed as a reinforcement for structural members. Fairly complicated machines such as described in U.S. Pat. No. 3,426,804 to R. M. Bluck have been designed to produce bias weave fabrics, but that particular machine forms a narrow strip (about 6") of bias woven fabric having a heavy weave. Furthermore, the machine itself is extremely cumbersome and expensive, and it would be very difficult and costly to increase the strip width capacity.

THE INVENTION

According to the invention, there is provided an apparatus and process for producing a continuous and endless fabric of ceramic or synthetic material at a bias to the fabric length which comprises: weaving a fabric in tubular form; passing the tube directly from the weaving operation through at least one pair of offset, matched, take up rolls while applying an equal force on both sides of the tubular fabric by engaging each side of the fabric separately and alternately with a corresponding offset roll; and, cutting or slitting the tubular fabric on a bias to form a lay flat sheet of bias oriented fabric of ceramic or synthetic fibers. The lay flat sheet is then coated with a lightly adhering backing sheet of paper, tape, polymer, fiberglass, fabric, etc., so that it can be readily handled and applied to a structural reinforcement member. Basically, the apparatus enables both sides of the tubular fabric to be taken up by the rolls without any slippage so that the bias cutting operation is performed on a uniformly woven tube, thereby maintaining a uniform weave in the bias oriented lay flat product.

DESCRIPTION OF THE PREFERRED EMBODIMENT

Figure 3:
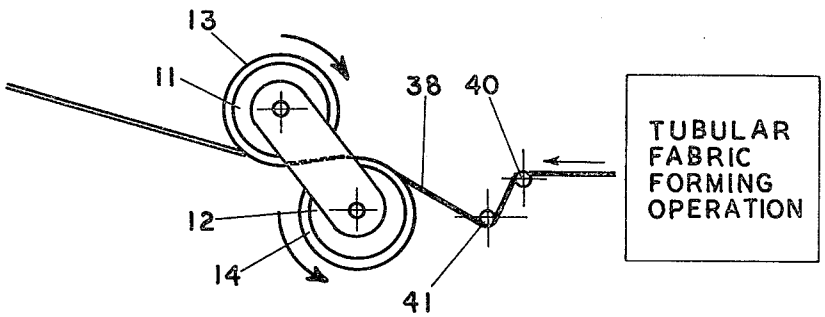
FIG. 3 is a schematic view of the tubular graphite fabric being advanced through the take up rolls.
Figure 1:
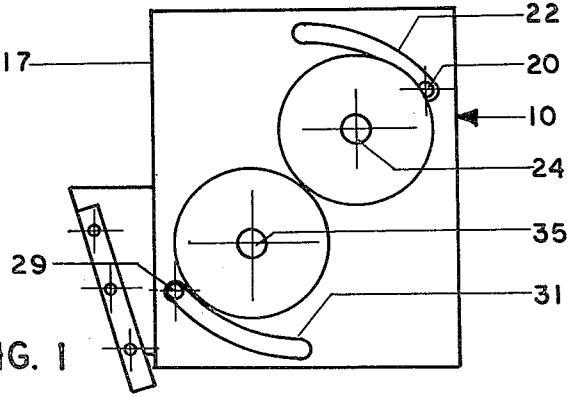
FIG. 1 is a side elevation view showing the take up roll system at the gear drive end for woven fabric such as graphite in tubular form.
Figure 2:
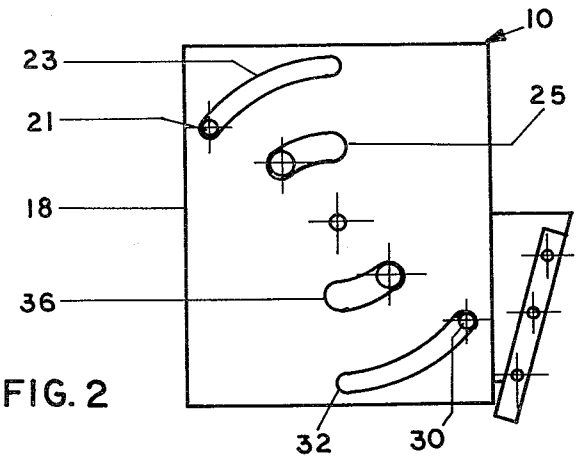
FIG. 2 shows a side elevation of the take up roll system at the idler end of the take up rolls.

The take up roll system 10 of this invention is shown in FIGS. 1–3, and is designed to ensure a uniform movement of woven fabric such as graphite after it leaves a combined weaving and tubular forming operation (using for example, a C-3 Crompton & Knowles loom). The usual take up rolls of the two roll high type cause an uneven uptake of the tubular fabric through the system, and this produces a fabric weave which is non uniform, and the use of such a fabric would result in a non uniform reinforcement of a structural member.

However, instead of the usual two roll high take up roll, matched rolls 11, 12 are employed and are off set as shown so that each roll contacts the fabric along a greater roll length compared to a two high roll mill, viz., about 20%–35% of a roll circumference; typical roll length sizes may vary from about 5–30 inches. To further ensure that an even uptake of tubular fabric is obtained, each roll is provided with a card clothing screen 13, 14 having a one way grain; this prevents the fabric from slipping or changing position as it passes through the rolls. In addition, matched gear drives 15, 16 are employed to move the fabric uniformly through the rolls, with no backlash.

The combined effect when using off set, matched rolls, a card clothing store, and matched gear drives ensures a uniform movement of the tubular fabric through the take up system. An adjustable arrangement for varying roll offset (i.e. the 20%–35% contact of roll circumference) includes plates 17, 18 on which the rolls are mounted at either end. Extension guide rods 20, 21 from top roll 11 fit into corresponding grooved slots 22, 23 in the respective plates 17, 18. The drive shaft 24 of roll 11 is fitted into corresponding slots, one slot 25 being shown on plate 18, and these slotted fittings permit adjustment of roll 11 within the two plates. Also, bottom roll 12 is adjustably mounted within plates 17 and 18 by means of extension guide rods 29, 30 which fit into corresponding grooved slots 31, 32; similarly, the drive shaft 35 of bottom roll 12 is adjustably mounted within grooved slots, one such slot 36 being shown on plate 18. The adjustable mounting of the two rolls enables them to accommodate for various thicknesses of graphite fabric, different textures, different throughput rates, etc. Nip distances between the rolls vary from about 0.025–0.25 inches.

Figure 4:
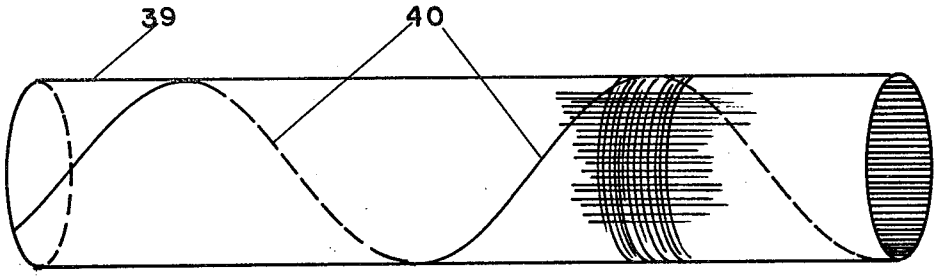
FIG. 4 shows the continuous tube of graphite fabric having a weave pattern oriented at 90° to the tube length after leaving the take up rolls; and, FIG. 5 shows a plan view of the unwound fabric in lay flat form after the tube has been cut diagonally to orient the weave at a bias to the fabric length.
Figure 5:
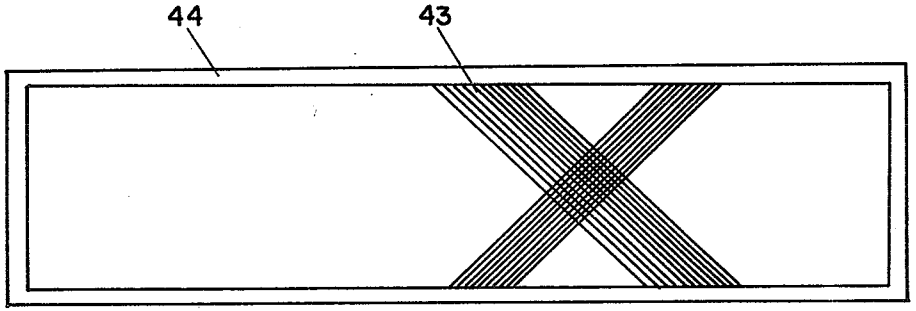

FIG. 3 illustrates the graphite fabric in tubular form 38 being forwarded immediately following a weaving operation, around tension bars 40, 41 and through the take up rolls 11 and 12 in the direction shown by the arrows. After leaving the take up rolls, the tubular graphite fabric 39 has a weave of uniform consistency, and oriented at 90° to the fabric length, as shown in FIG. 4. The tube is then cut at a diagonal 40 along the tube length and then simply unwound, as shown in FIG. 5 to produce a lay flat sheet 43 with the weave now oriented at a bias to the fabric length.

It is necessary that a thin adhesive backing sheet 44 (which may include paper, fiberglass, polymer, cloth, tape, etc.) be attached to the lay flat bias sheet to enable a user to apply the sheet to a reinforcing member without distorting the weave pattern.

The lay flat sheet of this invention provides a continuous, bias oriented fabric having a high degree of uniformity; it is easy to produce without requiring costly equipment or manpower. Furthermore, the fabric can easily and conveniently be produced in widths of about, say 50 inches compared to the narrow widths produced by the device disclosed in the aforementioned U.S. Pat. No. 3,426,804.

I claim:

1. A lay flat, continuous length of fabric having a weave oriented at a bias to the direction of the fabric length, the fabric being produced by the steps, comprising:

(a) weaving a fabric selected from the class consisting of ceramic or synthetic fibers into a tubular shape having a square of rectangular weave pattern oriented at 90° to the fabric length;

(b) immediately and continuously following the weaving step, passing the tubular woven fabric through at least one pair of matched offset take up rolls driven by matched gears, the rolls having a one way grain in the direction of roll travel;

(c) applying a uniform take up pressure to opposite sides of the tubular woven fabric by offset contact with a roll to an opposite side of the tube employing an equal roll force for sufficient surface contact of a respective roll circumference, thereby maintaining the 90° weave pattern uniform;

(d) cutting the tube diagonally to form a lay flat, continuous fabric having a uniform weave biased along its length; and, (e) applying a removable adhesive backing sheet to the lay flat fabric to reduce weave distortion when applied to a substrate.

2. The fabric of claim 1, in which the fibers are selected from the class consisting of: graphite, glass, quartz, aramid, polyester, nylon, saran and polyolefine.

3. The fabric of claim 1, in which each roll contacts the fabric for about 20%–35% of a roll circumference.

4. The fabric of claim 1, in which each roll is coated with a card clothing screen.

5. The fabric of claim 1 in which the fabric is graphite and the backing sheet is selected from the class consisting of: paper, cloth, polymer, fiberglass cloth and tape.

6. A process for converting woven, tubular fabric selected from the class consisting of ceramic or synthetic fibers into a continuous, endless length of lay flat fabric having a bias oriented weave, which comprises:

(a) weaving the fibers into a tubular fabric shape having a square or rectangular weave pattern oriented at 90° to the fabric length;

(b) immediately and continuously following the weaving step, passing the tubular woven fabric through at least one pair of matched offset take up rolls driven by matched gears, the rolls having a one way grain in the direction of roll travel;

(c) applying a uniform take up pressure to opposite sides of the tubular woven fabric by offset contact with a roll to opposite sides of the tube and employing an equal roll force for sufficient surface contact of a respective roll circumference, thereby maintaining the 90° weave pattern uniform;

(d) cutting the tube diagonally to form a lay flat, continuous fabric having a uniform weave biased along its length; and, (e) applying a removable adhesive backing sheet to the lay flat fabric to reduce weave distortion when applied to a substrate.

7. The process of claim 6, in which the take up rolls are covered by a card clothing screen.

8. The process of claim 6, in which each roll contacts a corresponding side of the tubular fabric for about 20%–35% of a roll circumference.

9. An apparatus for a 90° woven tubular ceramic or synthetic fabric from a tubular woven shape into a lay flat fabric length oriented at a bias to the fabric length, which comprises:

(a) means for forming a tubular fabric selected from the class consisting of ceramic and synthetic fibers having a weave pattern oriented at 90° to the direction of fabric length;

(b) means for immediately and continuously taking up the woven tubular fabric after leaving the weaving means while maintaining the weave pattern uniform, including:

i. at least one pair of matched offset take up rolls for the tubular fabric, the rolls being driven by matched gears and having a one way grain in the direction of roll travel; and, ii. the rolls being adapted to apply a uniform take up pressure to opposite sides of the tubular woven fabric by offset contact with a roll to opposite sides of the tube employing an equal roll force for sufficient surface contact of a respective roll circumference, thereby maintaining the 90° weave pattern uniform; and, (c) cutting means for the tube;

whereby the tube may be cut diagonally to form a lay flat, continuous fabric having a uniform weave biased along its length, the lay flat fabric bearing a removable adhesive backing sheet to reduce weave distortion when applied to a sustrate.

10. The apparatus of claim 9, in which the backing material is selected from the class consisting of: glass cloth, graphite, aramid, polyester, nylon, saran, quartz and polyolefin.

11. The apparatus of claim 9, in which the rolls are adjustably separated and each roll contacts a corresponding side of the tubular fabric for about 20%–35% of a roll circumference.

12. The apparatus of claim 11, in which the rolls are separated by a distance of about 0.025 to 0.25 inches.

* * * * *